US005802785A

United States Patent [19]

Crook

[11] Patent Number: 5,802,785

[45] Date of Patent: Sep. 8, 1998

[54] ALUMINUM FRAMED WINDOW MOLDING

[76] Inventor: Derek James Crook, 3283 Shearwater, Nanaimo, B.C., Canada, V9S 6A1

[21] Appl. No.: 806,249

[22] Filed: Feb. 21, 1997

[51] Int. Cl.[6] ..... E06B 3/54

[52] U.S. Cl. ..... 52/204.53; 52/204.5; 52/204.54; 52/730.3; 52/730.4; 52/730.6; 52/734.1; 52/773; 52/775

[58] Field of Search ..... 52/204.1, 204.5, 52/204.51, 204.53, 204.54, 656.5, 656.6, 717.01, 717.02, 730.3, 730.4, 730.5, 730.6, 734.1, 764, 773, 775; 49/DIG. 1, DIG. 2

[56] References Cited

U.S. PATENT DOCUMENTS

| | | | |
|---|---|---|---|
| 2,877,515 | 3/1959 | Hass | 52/730.6 X |
| 3,082,490 | 3/1963 | Loucks | 52/730.6 X |
| 3,196,998 | 7/1965 | Owen | 52/730.5 X |
| 3,827,207 | 8/1974 | Sharp et al. | 52/738.1 X |
| 4,204,373 | 5/1980 | Davidson | 52/204.1 |
| 4,328,644 | 5/1982 | Scott et al. | 52/656.5 X |
| 5,544,457 | 8/1996 | Labrecque | 52/730.5 X |

FOREIGN PATENT DOCUMENTS

| | | | |
|---|---|---|---|
| 2904295 | 8/1979 | Germany | 49/DIG. 1 |
| 3117139 | 2/1982 | Germany | 52/204.53 |
| 3012872 | 1/1995 | Germany | 52/204.5 |
| 461761 | 10/1968 | Switzerland | 52/204.53 |
| 739399 | 10/1955 | United Kingdom | 52/764 |
| 2279687 | 1/1995 | United Kingdom | 52/204.5 |

*Primary Examiner*—Lanna Mai
*Assistant Examiner*—Laura A. Callo

[57] ABSTRACT

A new Aluminum Framed Window Molding for insulating and preventing condensation on the metal frames of metal (e.g. aluminum) framed windows. The inventive device includes a horizontal member positioned above the metal window guide member of the metal framed window with the window seal end of the horizontal member abutting the window glass member of the metal framed window. A sill extension member is attached to the horizontal member and has a sill seal end which abuts the sill. An inner vertical member is disposed within a U-shaped channel defined by the metal window guide member and is attached to the bottom side of the horizontal member. A secondary sealing clip member may be included which is attached either to the sill extension member or the horizontal member. An outer vertical member disposed within the U-shaped channel and attached to the bottom side of the horizontal member may also be included.

16 Claims, 4 Drawing Sheets

ALUMINUM FRAMED WINDOW MOLDING

BACKGROUND OF THE INVENTION

1. Field of the Invention

The present invention relates to window frame molding and more particularly pertains to a new Aluminum Framed Window Molding for insulating and preventing condensation on metal frames of aluminum framed windows.

2. Description of the Prior Art

The use of window frame molding is known in the prior art. More specifically, window frame molding heretofore devised and utilized are known to consist basically of familiar, expected and obvious structural configurations, notwithstanding the myriad of designs encompassed by the crowded prior art which have been developed for the fulfillment of countless objectives and requirements.

Known prior art window frame molding include U.S. Pat. No. 4,257,202; U.S. Pat. No. 4,825,609; U.S. Pat. No. Des. 258,766; U.S. Pat. No. 4,811,533; U.S. Pat. No. 4,833,847 and U.S. Pat. No. 4,850,168.

While these devices fulfill their respective, particular objectives and requirements, the aforementioned patents do not disclose a new Aluminum Framed Window Molding. The inventive device includes a horizontal member positioned above the metal window guide member of the metal framed window with the window seal end of the horizontal member abutting the window glass member of the metal framed window. A sill extension member is attached to the horizontal member and has a sill seal end which abuts the sill. An inner vertical member is disposed within a U-shaped channel defined by the metal window guide member and is attached to the bottom side of the horizontal member. A secondary sealing clip member may be included which is attached either to the sill extension member or the horizontal member. An outer vertical member disposed within the U-shaped channel and attached to the bottom side of the horizontal member may also be included.

In these respects, the Aluminum Framed Window Molding according to the present invention substantially departs from the conventional concepts and designs of the prior art, and in so doing provides an apparatus primarily developed for the purpose of for insulating and preventing condensation on the metal frames of aluminum framed windows.

SUMMARY OF THE INVENTION

In view of the foregoing disadvantages inherent in the known types of window frame molding now present in the prior art, the present invention provides a new Aluminum Framed Window Molding construction wherein the same can be utilized for insulating and preventing condensation on the metal frames of aluminum framed windows.

The general purpose of the present invention, which will be described subsequently in greater detail, is to provide a new Aluminum Framed Window Molding apparatus and method which has many of the advantages of the window frame molding mentioned heretofore and many novel features that result in a new Aluminum Framed Window Molding which is not anticipated, rendered obvious, suggested, or even implied by any of the prior art window frame molding, either alone or in any combination thereof.

To attain this, the present invention generally comprises a horizontal member positioned above the metal window guide member of the metal framed window with the window seal end of the horizontal member abutting the window glass member of the metal framed window. A sill extension member is attached to the horizontal member and has a sill seal end which abuts the sill. An inner vertical member is disposed within a U-shaped channel defined by the metal window guide member and is attached to the bottom side of the horizontal member. A secondary sealing clip member may be included which is attached either to the sill extension member or the horizontal member. An outer vertical member disposed within the U-shaped channel and attached to the bottom side of the horizontal member may also be included.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Aluminum Framed Window Molding apparatus and method which has many of the advantages of the window frame molding mentioned heretofore and many novel features that result in a new Aluminum Framed Window Molding which is not anticipated, rendered obvious, suggested, or even implied by any of the prior art window frame molding, either alone or in any combination thereof.

It is another object of the present invention to provide a new Aluminum Framed Window Molding which may be easily and efficiently manufactured and marketed.

It is a further object of the present invention to provide a new Aluminum Framed Window Molding which is of a durable and reliable construction.

An even further object of the present invention is to provide a new Aluminum Framed Window Molding which is susceptible of a low cost of manufacture with regard to both materials and labor, and which accordingly is then susceptible of low prices of sale to the consuming public, thereby making such Aluminum Framed Window Molding economically available to the buying public.

Still yet another object of the present invention is to provide a new Aluminum Framed Window Molding which provides in the apparatuses and methods of the prior art some of the advantages thereof, while simultaneously overcoming some of the disadvantages normally associated therewith.

Still another object of the present invention is to provide a new Aluminum Framed Window Molding for insulating and preventing condensation on metal frames of aluminum framed windows.

Yet another object of the present invention is to provide a new Aluminum Framed Window Molding which includes a horizontal member positioned above the metal window guide member of the metal framed window with the window seal end of the horizontal member abutting the window glass member of the metal framed window. A sill extension member is attached to the horizontal member and has a sill seal end which abuts the sill. An inner vertical member is disposed within a U-shaped channel defined by the metal window guide member and is attached to the bottom side of the horizontal member. A secondary sealing clip member may be included which is attached either to the sill extension member or the horizontal member. An outer vertical member disposed within the U-shaped channel and attached to the bottom side of the horizontal member may also be included.

Still yet another object of the present invention is to provide a new Aluminum Framed Window Molding that can be made to fit a variety of metal framed windows, including casement type or sliding type windows, with metal window guides having different sized U-shaped channel.

Even still another object of the present invention is to provide a new Aluminum Framed Window Molding that prevents condensation on the inner frame surfaces of a metal framed windows not equipped with a thermal break.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
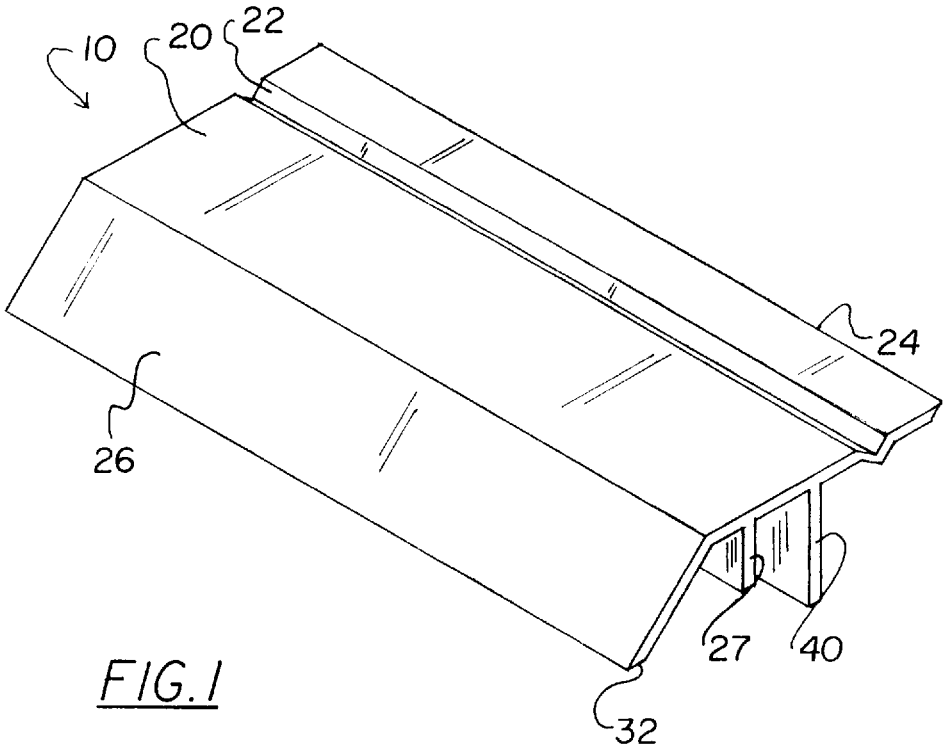
FIG. 1 is a perspective view of a new Aluminum Framed Window Molding according to the present invention.

With reference now to the drawings, and in particular to FIGS. 1 through 8 thereof, a new Aluminum Framed Window Molding embodying the principles and concepts of the present invention and generally designated by the reference numeral 10 will be described.

More specifically, it will be noted that the Aluminum Framed Window Molding 10 comprises a horizontal member 20, a sill extension member 30 attached to the horizontal member 20, an inner vertical member 40 attached to the bottom side of the horizontal member 20. A secondary sealing clip member 27 attached to either the sill extension member 30 or the horizontal member 20 may also be included. An outer vertical member 42 may also be attached to the bottom side of the horizontal member 20.

The Aluminum Framed Window Molding 10 is designed to extend around metal framed windows 70 having a window glass member 74, a metal frame member 75 extending around the periphery of the window glass member 74, a metal window guide member 60 positioned next to the a metal frame member 75 and extending along the length of inner perimeter of the metal framed window 70 around the window glass member 74, and a sill 76. The metal window guide member 60 has an inner side wall 62, an outer side wall 64, and a lower portion 66 which define a U-shaped channel 68 extending the length of the metal window guide member 60. While the invention is described in relation to metal framed window 70, it is to be understood that the principles described herein apply to aluminum framed windows and various other types of metal framed windows. It is also to be understood that this invention may be used with a variety of types of metal frame windows including sliding type and casement type metal framed windows.

As best illustrated in FIGS. 1 through 6, it can be shown that the horizontal member 20 has a window seal end 24 and an extension end 26. Attached to the extension end 26 is the sill extension member 30. The horizontal member 20 is positioned above the metal window guide member 60 with the window seal end 24 abutting next to the window glass member 74. It is important that the horizontal member 20 covers the metal frame member 75 and that the window seal end 20 touches the window glass member 74 to prevent condensation and provide sufficient insulation around the metal framed window 70.

The sill extension member 30 has a sill seal end 32 that abuts the sill 76 to provide a seal between the Aluminum Frame Molding 10 and the sill 76. The horizontal member 20 and the sill extension member 30 extend along the length of the metal window guide member 60 around the metal framed window 70. The horizontal member 20 may include a fitting groove portion 22 to help create a more secure seal between the window seal end 24 and the window glass member 74.

Figure 7:
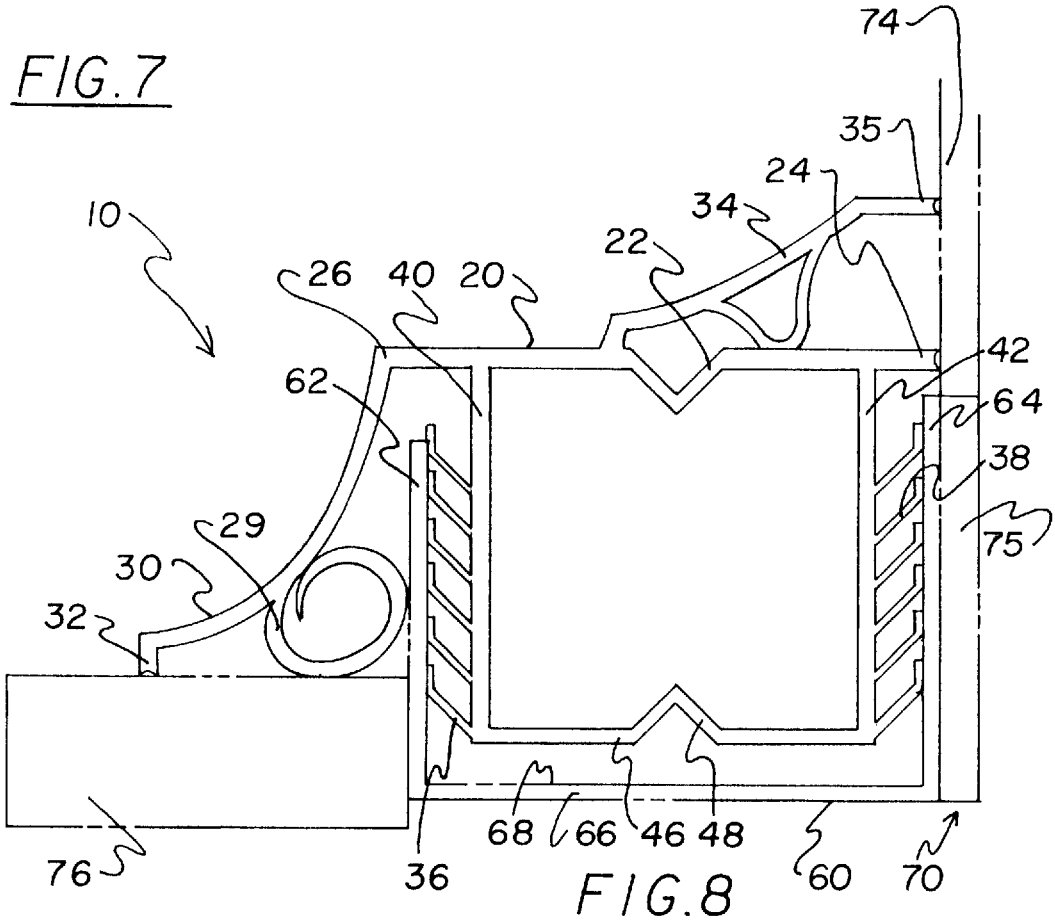
FIG. 7 is a side view of the invention showing the secondary window seal member.

As shown in FIG. 7, a secondary window seal member 34 is attached to the horizontal member 20 and abuts the window glass member 74 at its window seal end 35. The secondary window seal member 34 is necessary for casement or pop-out style windows to provide a secure seal between the Aluminum Frame Molding 10 and the outward opening window glass member 74.

Figure 3:
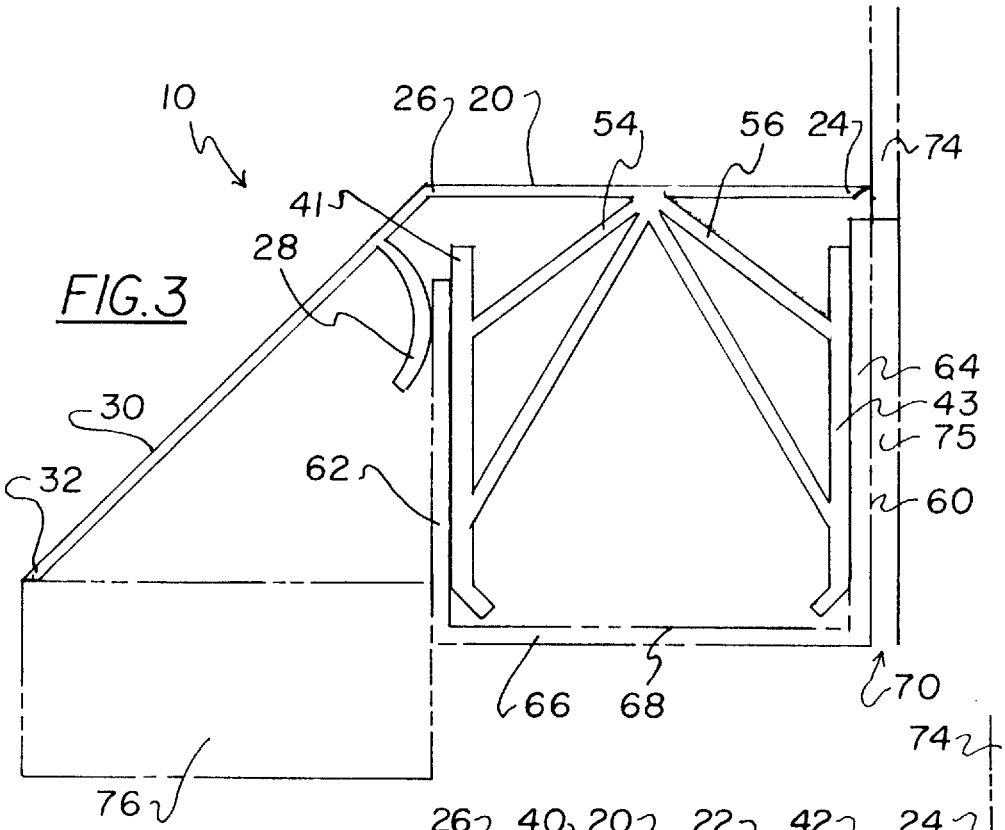
FIG. 3 is a side view of a version of the invention showing the inner and outer vertical brace members.

Extending downwards from the horizontal member 20 into the U-shaped channel 68 is the inner vertical member 40. The inner vertical member 40 may be directly attached to the bottom of the horizontal member 20 or as shown in FIG. 3 the inner vertical member 41 may be attached by at least one inner vertical brace member 54.

Figure 2:
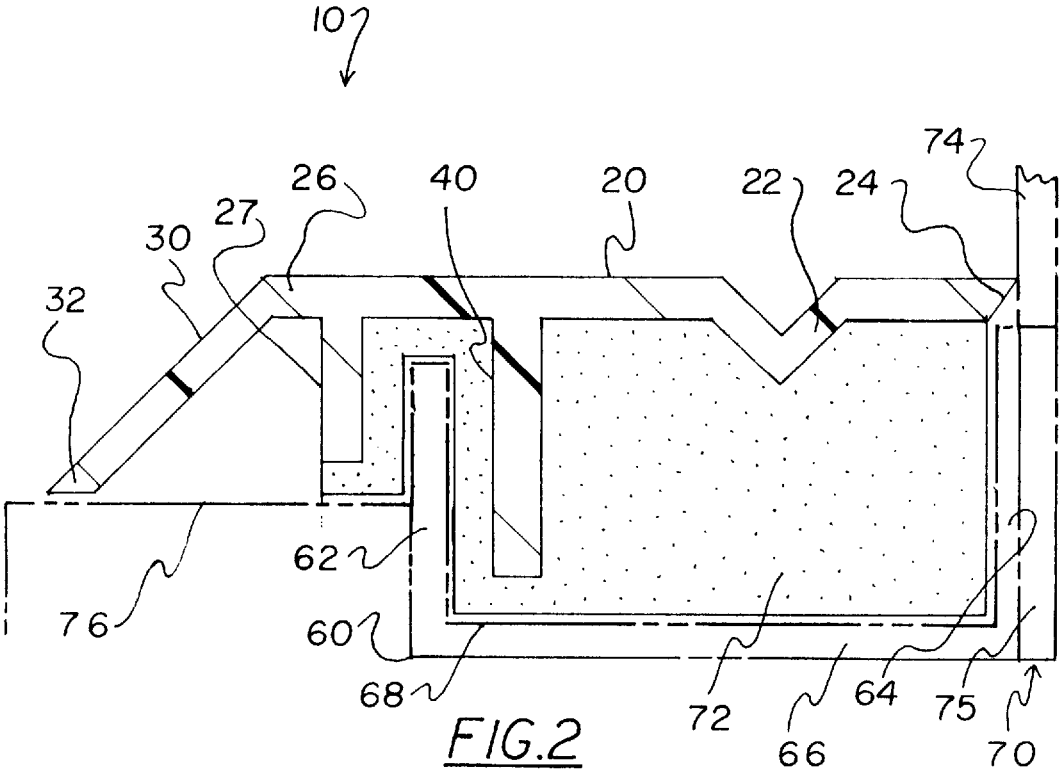
FIG. 2 is a side view of the invention in relation to a metal framed window with the U-shaped channel filled with insulation material.

The secondary sealing clip member 29 helps to hold the Aluminum Framed Window Molding 10 securely in the U-shaped channel 68 and acts as an additional air barrier. The secondary sealing clip member 29 generally is attached to the sill extension member 30 and touching the sill 76 and the metal window guide member 60. FIG. 3 shows another variation of the secondary sealing clip member 28 holding the Aluminum Framed Window Molding 10 against the metal window guide member 60. The secondary sealing clip member 27 may also be attached to the horizontal member 20 instead of the sill extension member 30 as shown in FIG. 2. The secondary sealing clip member 29 is made of a suitable flexible material such as soft vinyl or neoprene rubber.

The Aluminum Framed Window Moldings 10 may include an outer vertical member 42. The outer vertical member 42 is a necessary requirement for Aluminum Framed Window Moldings 10 for metal framed windows 70 that open outwards. The outer vertical member 42 is positioned within the U-shaped channel 68 and is spaced apart from the inner vertical member 40. The outer vertical member 42 may be directly attached to the horizontal member 20 or, as shown in FIG. 3, the outer vertical member 43 may be attached to the horizontal member 20 by at least one outer vertical brace member 56.

Together, the inner vertical member 40 and the outer vertical member 42 provide a means to form a friction fit against the walls of the U-shaped channel 68 to more securely hold the Aluminum Framed Window Molding 10. The fitting member 46 aides the rigidity of the inner vertical member 40 and the outer vertical member 42 in the U-shaped channel 68. The fitting member 46 is positioned between the inner vertical member 40 and the outer vertical member 42 and attached to both of them. The fitting member 46 has a fitting member groove portion 48 that allows the inner vertical member 40 and the outer vertical member 42 to be tightly fit against the walls of a variety of different sized U-shaped channels 68.

Figure 8:
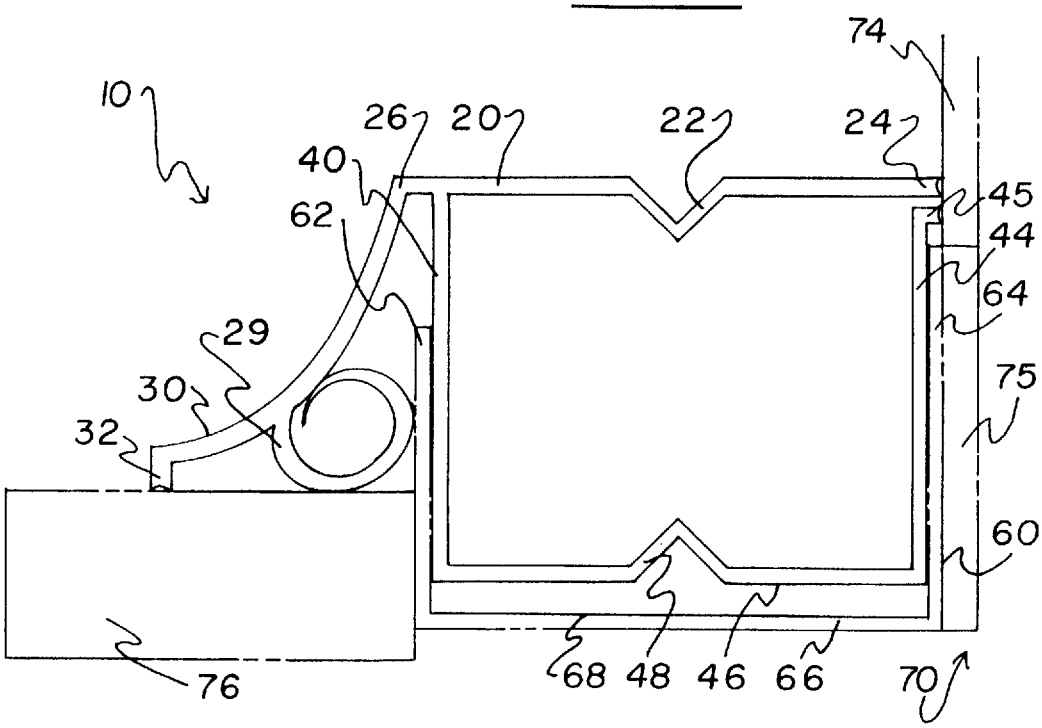
FIG. 8 is a side view of a version of the invention showing the outer vertical member with a window seal end.

If the dimensions of the U-shaped channel 68 for a particular window manufacturer are of a common size, the variation of the invention shown in FIG. 8 may be employed. In this variation, outer vertical member 44 is attached to the fitting member 46 but not to the horizontal member 20 forming a U-shaped clip. The outer vertical member 44 also includes a window seal end 45 that abuts the window glass member 74. In this variation, the surfaces of the inner vertical member 40 and the outer vertical member 44 may be coated in a thin layer of neoprene rubber to assist in friction fitting the U-shaped channel 68.

Figure 4:
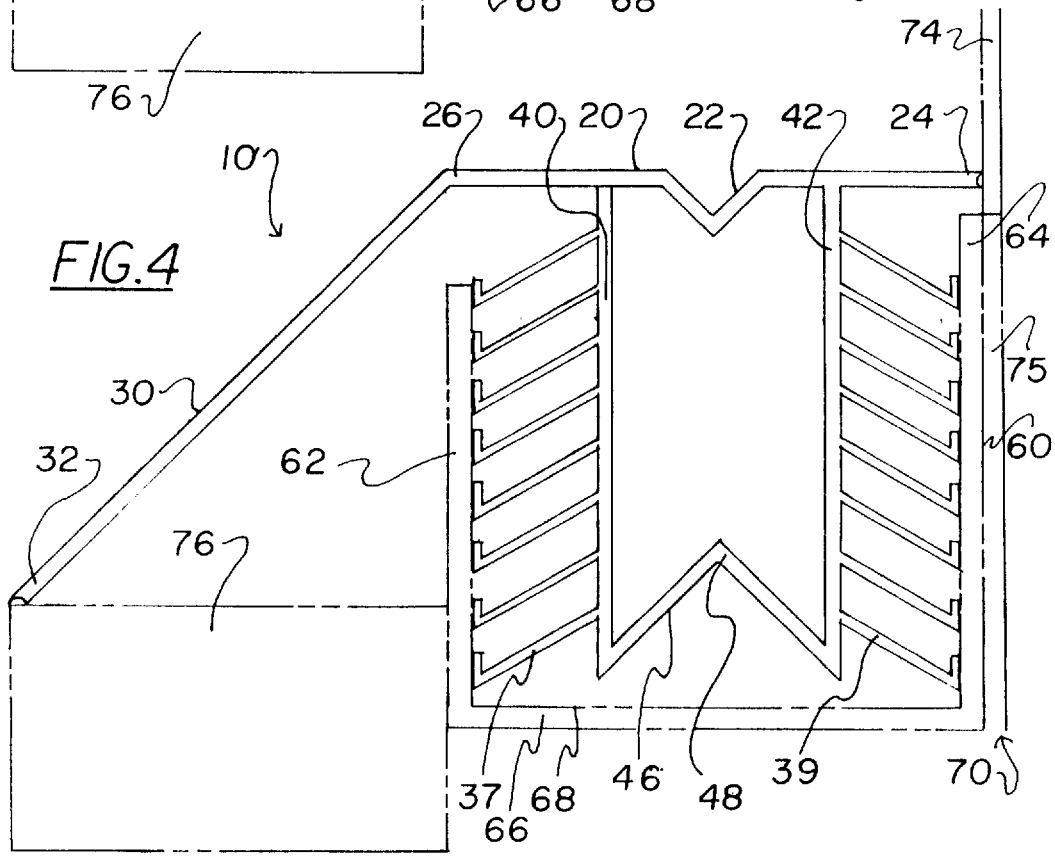
FIG. 4 is a side view of a version of the invention showing fitting member and the inner and outer fitting fins on the vertical members.

The inner vertical member 40 may include a plurality of inner fitting fins 36 and the outer vertical member 42 may include a plurality of outer fitting fins 38 to help to hold the Aluminum Framed Window Molding 10 to a variety of different sized U-shaped channels 68. The fitting fins are made of vinyl or neoprene rubber. The inner fitting fins 36 extend from the inner vertical member 40 towards the inner side wall 62. Likewise, the outer fitting fins 38 extend from the outer vertical member 42 towards the outer side wall 64. FIG. 4 shows a variation of the inner fitting fins 37 and outer fitting fins 39 extending at a downwards angle rather than an upwards angle from the inner vertical member 40 and the outer vertical member 42. The fitting fins reduce the surface contact of the Aluminum Framed Window Molding 10 with the metal window guide member 60 while also acting as a seal between the vertical members and the metal window guide member 60. The spaces between the individual fitting fins create dead air pockets for increased insulation.

Figure 5:
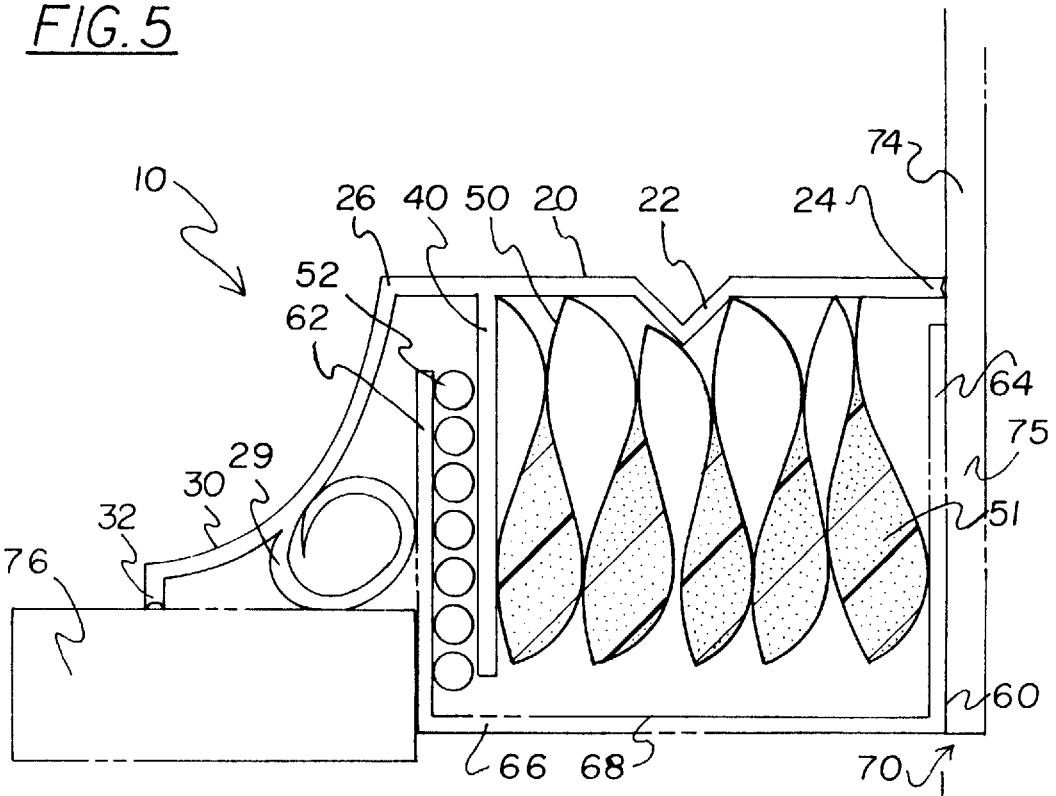
FIG. 5 is a side view of a version of the invention showing the vertical bellow member and a version of the secondary sealing clip member.
Figure 6:
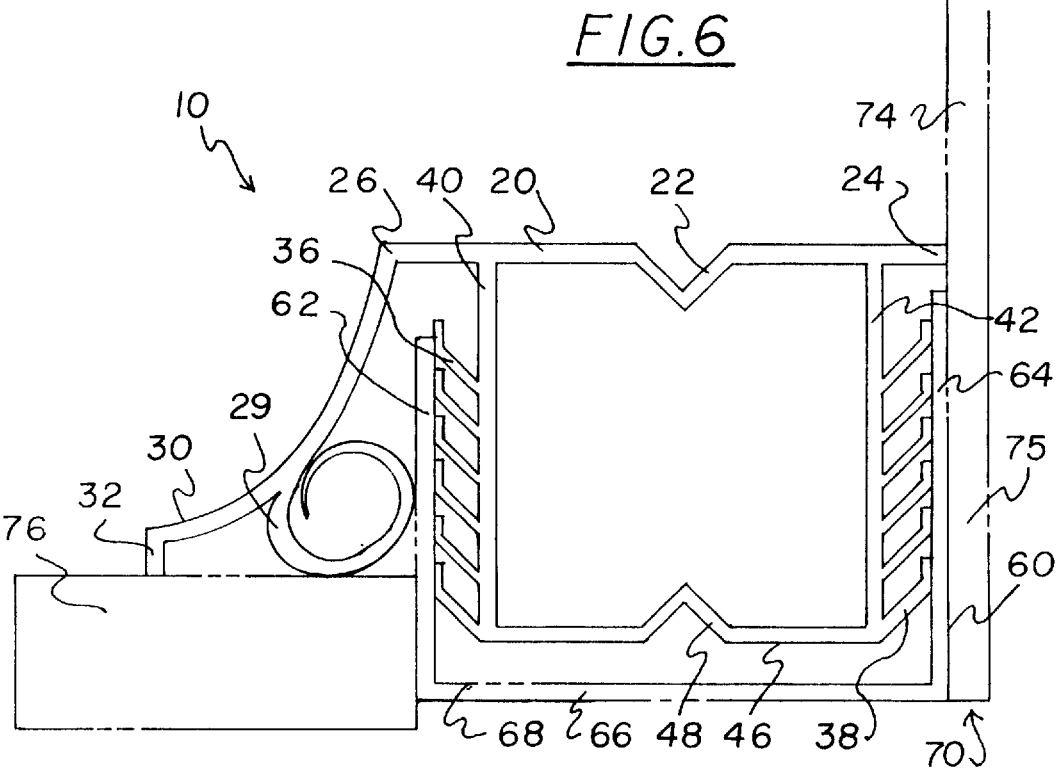
FIG. 6 is a side view of the invention showing the fitting member and a version of the inner and outer fitting fins on the vertical members.

FIG. 5 discloses another variation of the Aluminum Framed Window Molding 10 having a vertical bellow member 50 attached to the horizontal member 20 instead of an outer vertical member 42. The vertical bellow member 50 works along the same principles as the fitting fins and allows the invention to fit in metal framed windows 70 having U-shaped channels 68 of various widths and depths. The vertical bellow member 50 has a plurality of insulated bellow portions 51 disposed within the U-shaped channel 68 and are filled with an expanding foam insulation to help friction fit the Aluminum Framed Window Molding to the metal window guide member 60 and aid insulation. In this variation of the Aluminum Framed Window Molding 10, the inner vertical member 40 includes a plurality of friction fitting insulating ribs 52. The friction fitting insulating ribs 52 are positioned between the inner vertical member 40 and the inner side wall 62. The friction fitting ribs 52 are made of soft vinyl or neoprene.

As shown in FIG. 2, insulation material 72 may be disposed within said U-shaped channel 68 around the Aluminum Framed Window Molding 10. The insulation material 72 helps to securely hold the Aluminum Framed Window Molding 10 to the metal window guide member 60 and provide additional insulation. The insulation material 72 may be a closed cell polyurethane foam.

As disclosed, the components of the Aluminum Framed Window Molding 10 are made of extruded polyvinylchloride ("vinyl") unless previously noted. However, it to be understood that the Aluminum Framed Window Molding 10 may be made of a variety of materials suitable for insulating window moldings such as plastic or wood. The Aluminum Framed Window Molding 10 may also be made of sufficiently flexible material to fit around arched metal framed windows 70 having a U-shaped channel 68. The horizontal member 20, the sill extension member 30 can be made of various materials and thickness to achieve a variety of insulation properties for the Aluminum Framed Window Molding 10.

The Aluminum Framed Window Molding 10 may consist of multiple pieces to allow easy installation and disengagement into a metal framed window 70. Pre-made corner pieces may also be constructed to allow changes in direction and help support the upper horizontal Aluminum Framed Window Moldings 10 along the sides of the metal framed window 70.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An aluminum framed window molding in combination with a metal framed window having a window glass member, a sill, and a metal window guide member having a U-shaped channel being defined by an inner side wall, an outer side wall, and a lower portion, said aluminum framed window molding comprising:

a horizontal member having a window seal end and an extension end, said horizontal member being positioned above said metal window guide member, said window seal end being abutted next to said window glass member;

a sill extension member having sill seal end. said sill extension member being coupled to said extension end, said sill seal end being abutted next to said sill;

an inner vertical member being disposed within said U-shaped channel and being coupled to said horizontal member; and wherein said horizontal member includes a fitting groove portion.

2. The aluminum framed window molding of claim 1, further comprising a secondary sealing clip member downwardly depending from said horizontal member.

3. The aluminum framed window molding of claim 1, further comprising a secondary sealing clip member downwardly depending from said sill extension member.

4. The aluminum framed window molding of claim 1, further comprising an outer vertical member being disposed within said U-shaped channel and being spaced apart from said inner vertical member. said outer vertical member being coupled to said horizontal member.

5. The aluminum framed window molding of claim 4, further comprising a fitting member having a fitting member groove portion and being positioned between said inner vertical member and said outer vertical member. said fitting member being coupled to said inner vertical member and to said outer vertical member.

6. The aluminum framed window molding of claim 4, wherein said inner vertical member includes a plurality of inner fitting fins, said inner fins being extended from said inner vertical member towards said inner side wall of said metal window guide member, and wherein said outer vertical member includes a plurality of outer fitting fins, said outer fitting fins being extended from said outer vertical member towards said outer side wall of said metal window guide member.

7. The aluminum framed window molding of claim 4 wherein said outer vertical member is downwardly depending from said horizontal member.

8. The aluminum framed window molding of claim 1, further comprising a vertical bellow member having a plurality of insulated bellow portions, said vertical bellow member downwardly dependinig from said horizontal member and being disposed within said U-shaped channel of said metal window guide member.

9. The aluminum framed window molding of claim 1, wherein said inner vertical member includes a plurality of friction fitting insulating ribs being disposed between said inner vertical member and said inner side wall of said metal window guide member.

10. The aluminum framed window molding of claim 1, further comprising a fitting member having a fitting member groove portion, said fitting member being coupled to said inner vertical member, and a outer vertical member being disposed within said U-shaped channel and being spaced apart from said inner vertical member, said outer vertical member being coupled to said fitting member.

11. The aluminum framed window molding of claim 10, wherein said outer vertical member has a window seal end, said window seal end of said outer vertical member being abutted next to said window glass member.

12. The aluminum framed window molding of claim 1, further comprising insulation material being disposed within said U-shaped channel.

13. The aluminum framed window molding of claim 1, further comprising a secondary window seal member having a window seal end and being coupled to said horizontal member, said window seal end being abutted next to said window glass member.

14. The aluminum framed window molding of claim 1, wherein said inner vertical member is downwardly depending from said horizontal member.

15. An aluminum framed window molding, in combination with a metal framed window having a window glass member, a sill, and a metal window guide member having a U-shaped channel being defined by an inner side wall, an outer side wall, and a lower portion, said aluminum framed window molding comprising:

a horizontal member having a window seal end and an extension end, said horizontal member being positioned above said metal window guide member, said window seal end being abutted next to said window glass member;

a sill extension member having sill seal end, said sill extension member being coupled to said extension end, said sill seal end being abutted next to said sill;

an inner vertical member being disposed within said U-shaped channel and being coupled to said horizontal member;

wherein said inner vertical member being coupled to said horizontal member by at least one inner vertical brace member; and an outer vertical member having at least one outer vertical brace member, said outer vertical member being disposed within said U-shaped channel and being spaced apart from said inner vertical member, and said outer brace member being coupled to said horizontal member.

16. An aluminum framed window molding, for a metal framed window having a window glass member, a sill, and a metal window guide member having a U-shaped channel being defined by an inner side wall, an outer side wall, and a lower portion, said aluminum framed window molding comprising:

a horizontal member having a window seal end and an extension end, said horizontal member being for positioning above said metal window guide member, said window seal end being for abutting next to said window glass member;

a sill extension member having sill seal end, said sill extension member being coupled to said extension end, said sill seal end being for abutting next to said sill;

an inner vertical member being for positioning within said U-shaped channel and being coupled to said horizontal member; and wherein said horizontal member includes a fitting groove portion.

* * * * *